US006729052B2

(12) United States Patent
Ollinger, IV et al.

(10) Patent No.: US 6,729,052 B2
(45) Date of Patent: May 4, 2004

(54) ASSEMBLY FOR SECURING AN EXCAVATING TOOTH

(75) Inventors: Charles G. Ollinger, IV, Aloha, OR (US); Noah David Cowgill, Portland, OR (US)

(73) Assignee: ESCO Corporation, Portland, OR (US)

( * ) Notice: Subject to any disclaimer, the term of this patent is extended or adjusted under 35 U.S.C. 154(b) by 213 days.

(21) Appl. No.: 09/986,705

(22) Filed: Nov. 9, 2001

(65) Prior Publication Data

US 2003/0089003 A1 May 15, 2003

(51) Int. Cl.[7] ..... E02F 9/28
(52) U.S. Cl. ..... 37/452; 403/374.4
(58) Field of Search ..... 37/449, 450, 452, 37/453, 454, 455, 456, 457; 403/350, 374.3, 374.4, 372; 172/753, 772

(56) References Cited

U.S. PATENT DOCUMENTS

| | | | | | |
|---|---|---|---|---|---|
| 2,772,492 | A | | 12/1956 | Murtaugh | |
| 3,879,867 | A | | 4/1975 | Ericson et al. | |
| 3,919,792 | A | * | 11/1975 | Hahn et al. | 37/455 |
| 4,205,469 | A | * | 6/1980 | Johansson et al. | 37/457 |
| 4,414,764 | A | * | 11/1983 | Johansson et al. | 37/450 |
| 4,470,210 | A | | 9/1984 | Hahn | |
| 4,481,728 | A | | 11/1984 | Mulder et al. | |
| 4,748,754 | A | * | 6/1988 | Schwappach | 37/451 |
| 4,891,893 | A | * | 1/1990 | Bowes, Jr. | 37/328 |
| 5,088,214 | A | | 2/1992 | Jones | |
| 5,177,886 | A | * | 1/1993 | Klett | 37/452 |
| 5,233,770 | A | | 8/1993 | Robinson | |
| 5,311,681 | A | | 5/1994 | Ruvang et al. | |
| 5,325,615 | A | | 7/1994 | Hutchins et al. | |
| 5,386,653 | A | * | 2/1995 | Cornelius | 37/454 |
| 5,394,629 | A | | 3/1995 | Ruvang et al. | |
| 5,438,774 | A | * | 8/1995 | Fletcher et al. | 37/456 |
| 5,526,593 | A | | 6/1996 | Coppage | |
| 5,561,925 | A | * | 10/1996 | Livesay | 37/455 |
| 5,564,206 | A | | 10/1996 | Ruvang | |
| 5,638,621 | A | * | 6/1997 | Keech et al. | 37/446 |
| 5,653,048 | A | | 8/1997 | Jones et al. | |
| 5,713,145 | A | * | 2/1998 | Ruvang | 37/458 |
| 5,806,215 | A | | 9/1998 | Matthews | |
| 5,806,216 | A | | 9/1998 | Renski | |
| 5,909,962 | A | * | 6/1999 | Livesay et al. | 37/456 |
| 5,918,391 | A | * | 7/1999 | Vinas Peya | 37/452 |
| 5,983,534 | A | | 11/1999 | Robinson et al. | |
| 6,030,143 | A | | 2/2000 | Kreitzberg | |
| 6,047,487 | A | | 4/2000 | Clendenning | |
| 6,079,132 | A | | 6/2000 | Clendenning | |
| 6,108,950 | A | | 8/2000 | Ruvang et al. | |
| 6,240,663 | B1 | * | 6/2001 | Robinson | 37/458 |
| 6,321,471 | B2 | * | 11/2001 | Fernandez Munoz et al. | 37/456 |
| 6,393,739 | B1 | * | 5/2002 | Shamblin et al. | 37/456 |

* cited by examiner

*Primary Examiner*—Victor Batson
(74) *Attorney, Agent, or Firm*—Banner & Witcoff, Ltd.

(57) ABSTRACT

An assembly for mounting an excavating tooth particularly suited for a dredge cutterhead includes a base, an adapter, and a lock. The base includes a convex, curved bearing surface that abuts a concave, curved bearing surface on the adapter. The curved bearing surfaces are able to maintain substantially full contact with each other under transverse loading.

45 Claims, 11 Drawing Sheets

ASSEMBLY FOR SECURING AN EXCAVATING TOOTH

FIELD OF THE INVENTION

The present invention pertains to an assembly for securing an excavating tooth to excavating equipment, and in particular, for mechanically attaching an adapter to a dredge cutterhead.

BACKGROUND AND SUMMARY OF THE INVENTION

Dredge cutterheads are used for excavating earthen material that is underwater, such as a riverbed. One example of a dredge cutterhead is illustrated in FIG. 17. In general, a dredge cutterhead include several arms 11 that extend forward from a base ring 16 to a hub 23. The arms are equally spaced about the base ring and formed with a broad spiral about the central axis of the cutterhead. Each arm is provided with a series of spaced apart teeth 12 to dig into the ground.

In use, the cutterhead is rotated about its central axis to excavate the earthen material. To excavate the desired swath of ground the cutterhead is moved side-to-side as well as forward. On account of swells and other movement of the water, the cutterhead will also tend to move up and down, and periodically impact the bottom surface. As a result of this unique cutting action, the teeth of a dredge cutterhead experience heavy transverse as well as axial loading and heavy impact jacking loads that thrust the tooth up, down and sideways. The heavy transverse loading of the tooth is further engendered by the operator's inability to see the ground that is being excavated underneath the water. Unlike other excavators (e.g., a front end loader), the operator of a dredge cutterhead cannot effectively guide the cutterhead along a path to best suit the terrain to be excavated.

Due to the rotative digging action of the cutterhead, each tooth penetrates the ground on the order of 30 times a minute as compared to about 1 time a minute for mining teeth. As a result, the teeth experience a great amount of wear during use. It is desirable therefore for the teeth to be easily removed and installed to minimize downtime for the cutterhead. As is common with wear assemblies for excavating equipment, dredge teeth comprise a plurality of integrally connected parts so as to minimize the amount of material needing replacement, i.e., only the worn components need to be replaced.

In the example of FIG. 17, each tooth includes a base 18, an adapter 13, a point or tip 17, and a lock 29. The base 18 is cast on the arm 11 at a particular location and orientation to maximize digging. Adapter 13 includes a rear end 22 that is received in a socket 14 defined in the base, and a forwardly projecting nose 15 to hold the point 17. A removable lock 29 is provided to facilitate the required frequent replacement of the tooth points 17. The adapter is held in the socket by a large fillet weld about the circumference of the rear end 22. In other known dredge cutterheads 1, the adapter 2 is bifurcated to define a pair of legs that are configured to wrap about the arm 3 (FIG. 18). These adapters are welded directly to the arm without a base member.

Although the tooth points require the most frequent replacement in a dredge cutterhead, the adapters still wear and need periodic replacement. However, replacing even a single adapter on a dredge cutterhead is a long process. The welded adapter must first be cut off with a torch. Then, portions of the arm and base that were damaged by the removal of the adapter must be repaired and rebuilt. Finally, a new adapter is welded into place. This process typically entails 10–12 man-hours per adapter. Hence, a lengthy delay in a dredging operation is unavoidable even when replacing only a single adapter. Moreover, in view of this lengthy delay, an operator will often wait until several adapters need replacement to take the cutterhead out of operation. As a result, the actual delay in operation that usually results is longer. Indeed, with a typical cutterhead having 50–60 teeth a rebuilding process of the entire cutterhead could require more than 600 man-hours. In an effort to avoid substantial loss of dredging time, most dredging operations maintain three or four cutterheads so that the entire cutterhead can be exchanged when one or more adapter needs to be replaced, the cutterhead needs to be rebuilt, or if the cutterhead breaks. However, a cutterhead is expensive. The maintaining of extra cutterheads that are not used, but held only when the one in use is serviced is an undesirable use of resources.

In one aspect of the present invention, the adapter is mechanically attached to the arm for easy installation and removal. The adapter is held to a base on the arm solely by a mechanical construction without the need for welding the adapter. In the preferred construction, the base and adapter are formed with complementary coupling configurations to prevent release of the adapter from the base except in a release direction. A removable lock is used to prevent undesired release of the adapter from the base in the release direction. With a mechanical attachment, the adapter can be easily replaced by simply removing the lock and moving the adapter in the release direction. There is no weld to be cut, no need to repair the base and arm, and no re-application of a weld. As opposed to 10–12 man-hours for replacing a welded adapter, a mechanically attached adapter in accordance with the present invention can be changed in as little as 10 minutes. This is a dramatic improvement which not only substantially reduces downtime for the cutterhead, but can also make the elimination of an entire spare cutterhead at the dredging site possible. As a result, instead of typically needing three or four cutterheads at a dredge site, only two or three may be needed.

In the preferred construction of the present invention, the adapter includes a T-shaped slot that receives a T-shaped tongue on the base, and an opening for receiving a lock. The lock, when inserted into the opening, opposes a wall of the base and a wall of the opening to prevent release of the T-shaped tongue and slot, and thereby hold the adapter to the base.

It is common for adapters of various excavators, such as a front end loader, to be mechanically attached to the excavating bucket. For example, U.S. Pat. No. 5,653,048 discloses an adapter with a T-shaped slot that receives a T-shaped boss welded to the lip of an excavating bucket. A lock is fit within an opening in the top of the adapter to prevent loss of the adapter from the lip. A bearing surface is formed at the front end of the boss to provide axial support for the adapter. While this construction well supports an adapter on an excavating bucket, it is not well suited for use on a dredge cutterhead.

In an excavating bucket, the teeth are primarily subjected to axial loading as the bucket is driven forward through the ground. However, as discussed above, the teeth on a dredge cutterhead are subjected to heavy and frequent transverse loads due to the manner in which the cutterhead is operated. In the noted '048 patent, the adapter 4 is slid onto the boss 5 with a slight side clearance for ease of assembly. The application of a large side load L applied against the tooth point 6 tends to rotate the adapter about the received boss to the extent of the defined clearance between the parts (FIG. 16). This rotation of the adapter results in the generation of resistant forces R1–R4 and high stresses being generated through essentially "point" contacts in the corners of the assembly. Although true point contact is impossible, the term is used to identify large applications of force over a relatively small area. In particular, the application of large forces R2, R3 at "points" on the front of the base and the lock 7 place exceptionally high levels of stress on the components. Such high stress levels, in turn, cause greater wearing of the parts at these locations and a shortened usable life of the parts. The increased wearing also enlarges the clearance space, which can lead to rattling of the components during use. Such rattling of the parts further quickens wearing of the parts.

In ordinary digging, such as with a front end loader, fines become impacted between the adapter and base so that rattling is reduced or eliminated even when wearing has created large gaps between the parts. However, in a dredging operation, the water sweeps the fines in and out of the gaps, and prevents the build up of fines between the parts. Since the gaps between the parts would ordinarily remain in a dredging operation, an adapter mechanically attached to a boss on a dredge cutterhead by a known construction would continually rattle against the boss and repeatedly apply large loads in point contacts along the front and rear of the adapter. Moreover, since the fines are constantly swept into and out of the gaps between the parts with the water, the fines would actually function as a grinding compound on the parts to further exacerbate wearing of the parts. Consequently, adapters for dredging operations have not before been mechanically attached to the dredge cutterhead arms.

However, these shortcomings are overcome in the present invention so that adapters in dredging teeth can be mechanically attached to the arms. In particular, the front of the base is curved and in contact with a complementary abutment of the adapter. As a result, when side loads push the adapter in a rotative manner, the arcuate shape of the bearing surfaces enables the surfaces to remain in substantially full flush contact with each other. This full contact arrangement as opposed to a point contact greatly reduces the stress otherwise experienced in the corners of the components. Rather than having high loads applied essentially as point contacts, the loads are spread over substantially the entire bearing surface to greatly minimize the stress in the parts and, in turn, substantially lengthen the usable life of the parts.

In a preferred construction, the arcuate bearing surfaces define spherical segments to maintain substantially full contact between the bearing surfaces of the adapter and the base under both horizontal and vertical transverse loading. In addition, the rear bearing surface of the base and the front of the lock are also preferably formed with similar arcuate surfaces to likewise maintain substantially full contact between the lock and the base.

In another aspect of the present invention, the lock is formed to tighten the connection between the base and adapter. A tightened assembly alleviates rattling and thereby lengthens the useful life of the tooth. The above-noted '048, patent discloses a lock with a threaded plug that tightens the adapter on the boss. Nevertheless, the stress and strains of digging can work to loosen even an initially tightened arrangement such that the adapter will still shift and rattle against the base resulting in increased wear, particularly with the high frequency of penetration and varied loading of teeth on a dredge cutterhead. Further, with a loosening assembly, there would be nothing in a water environment to prevent the components from rattling during use.

Therefore, in accordance with another aspect of the present invention, the lock further includes a resilient element that cooperates with an actuator to maintain a tight engagement between the adapter and base even after loads have introduced wear between the parts. The resilient element is sandwiched between a pair of rigid members. The actuator initially pulls the adapter into a tight engagement with the base and draws the rigid members together to compress the resilient element. As looseness begins to develop in the assembly due to wearing, the resilient element expands to dampen any shifting or rattling of the adapter on the base and thereby maintain a tight engagement between the two components. The rigid members also preferably have at least one stop that prevents excessive compression of the resilient element. In this way, the rigid members initially form a rigid lock that is tightly set between the adapter and the base, and which also protect the internal resilient element from premature failure on account of being overloaded.

As discussed above, the arms in a dredge cutterhead have a broad spiraling configuration. As a result, the teeth each project from the arm at a unique orientation to maximize digging. Since the teeth are mounted in different orientations on the arm, care must be taken to ensure that each adapter is properly positioned on the arm. This additional positioning procedure further lengthens the time needed to install new adapters in past cutterheads. In the example illustrated in FIG. 17, a resin is poured into the socket to harden around the first mounted adapter to thus form a recess adapted to properly orient successive adapters for the dredging operation. Nevertheless, this design still requires a careful, time-consuming procedure to initially place the adapters properly on the arm as well as the extra work of pouring and curing the resin.

In another aspect of the present invention, the arm is formed with a locator nose along the front edge of the arm that is set at the desired orientation. A separable base member is provided with a complementary recess that is adapted to receive the nose so as to support and position the adapter properly on the arm. As a result, the positioning of the adapter in the present invention is easy and quick.

DETAILED DESCRIPTION OF THE PREFERRED EMBODIMENTS

Figure 1:
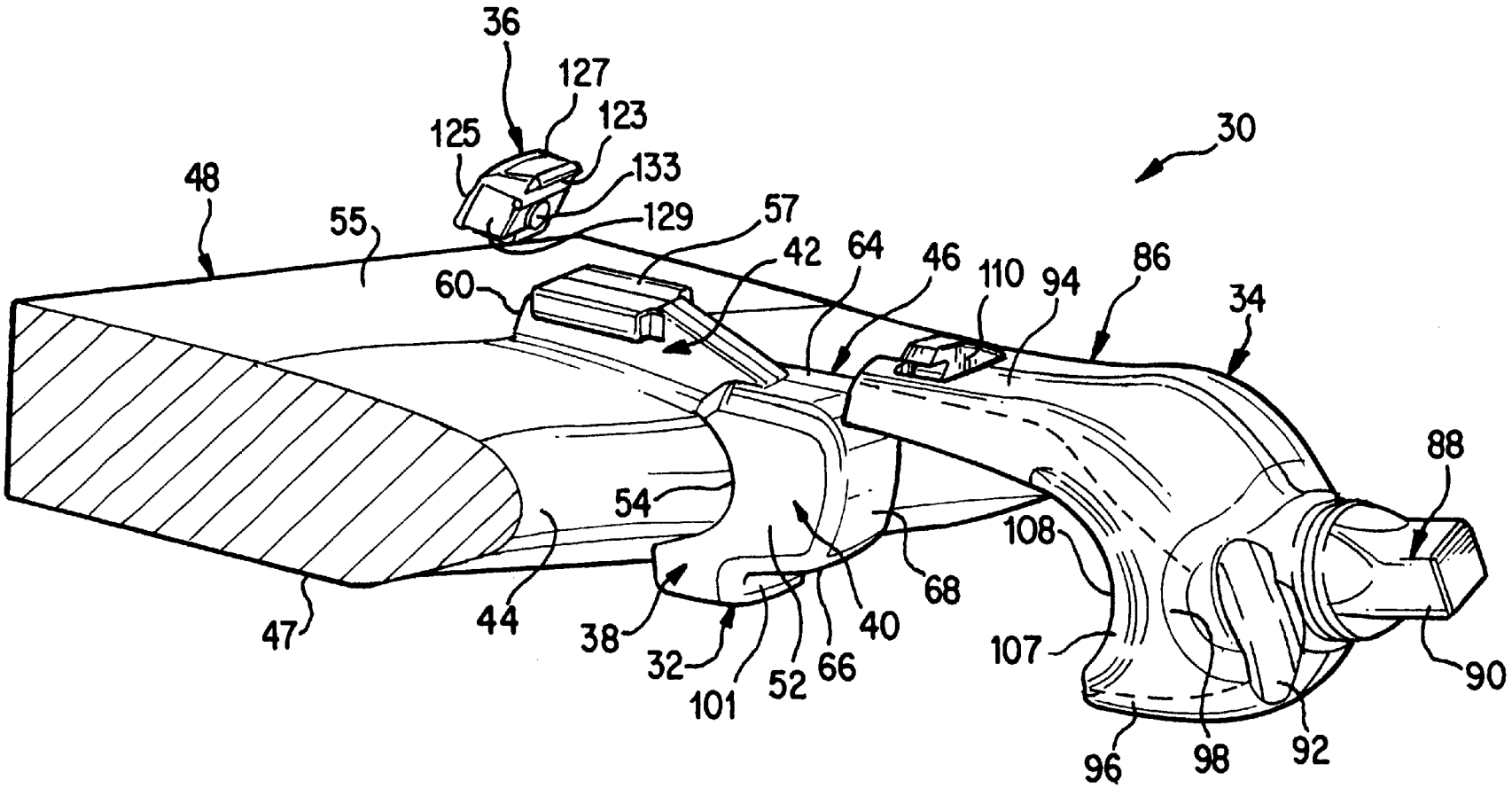
FIG. 1 is a front perspective exploded view of an attachment assembly in accordance with the present invention.

The present invention pertains to an assembly for securing an excavating tooth 30. This tooth is particularly suited for use on a dredge cutterhead because of the ability of the tooth in the preferred construction to better withstand heavy transverse loading typical of a dredging operation and dampen rattling of the parts. Nevertheless, a tooth in accordance with the present invention could be used with other excavators. The tooth includes a base or mount 32, an adapter 34, a point (not shown), and a lock 36 (FIG. 1). The tooth components will at times be described in relative terms, such as up and down, even though the operation of the dredging equipment will cause the teeth to assume many different orientations. These directions are used for explanation purposes only and should ordinarily be understood with respect to the orientation in FIG. 1.

In the preferred construction, base 32 has a lower leg 38, a front body 40 and an upper leg 42 in a generally U-shaped configuration (FIGS. 1–4) that wraps around the front edge 44 of an arm 48 of a cutterhead for enhanced support. The base is preferably a cast one-piece product that is fixed to the arm by welding, but could be constructed as a multi-piece welded component. Alternatively, the base could be fixed to the arm as a structure that is cast as a unitary part of the arm (not shown).

Lower leg 38 need extend only a short distance along a lower side 47 of arm 48, although an extended construction could be used. Upper leg 42 extends rearward along an upper side 55 of arm 48 and includes a coupling configuration 56 for securing the adapter. Since the lower or inner side 47 of an arm of a dredge cutterhead is more difficult to access, the coupling configuration is preferably formed to be on the upper or outer side 55 of the arm. Nevertheless, alternative constructions are possible. For instance, the legs could be reversed on the arm or a coupling configuration could be provided on both of the upper and lower sides of the arms. The legs 38, 42 and body 40 collectively define an inner surface 54 that faces the arm. To facilitate effective welding of the base to the arm, the inner surface 54 is shaped to substantially conform to the contour of the portion of arm 48 it opposes. The base is welded to the arm along substantially its entire perimeter to securely fix the base to the cutterhead.

Figure 2:
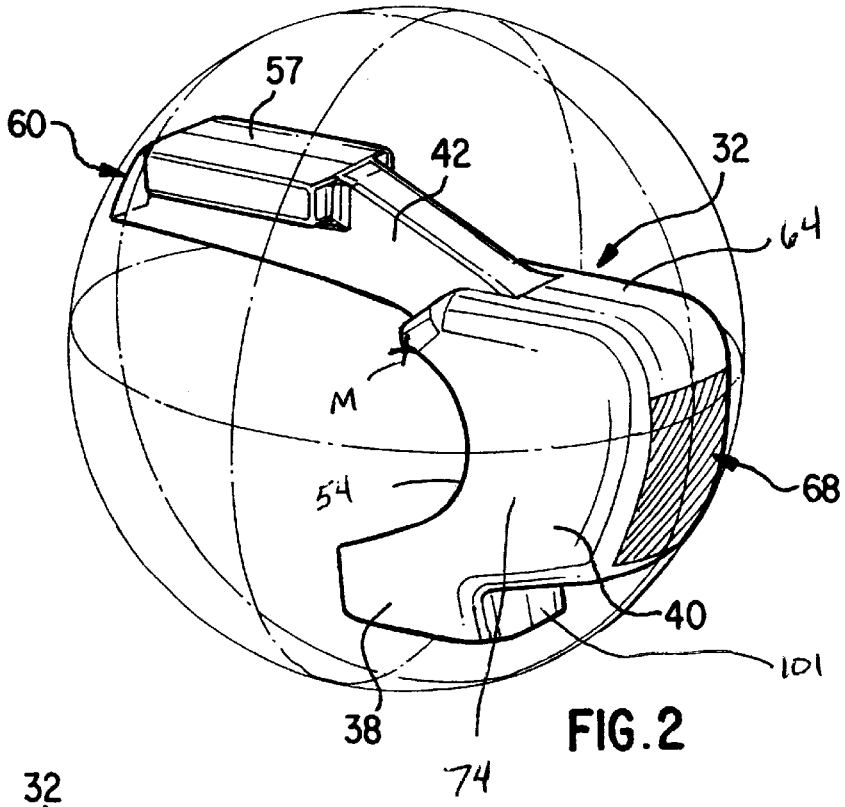
FIG. 2 is a perspective view of a base in accordance with the present invention in conjunction with an imaginary sphere.
Figure 3:
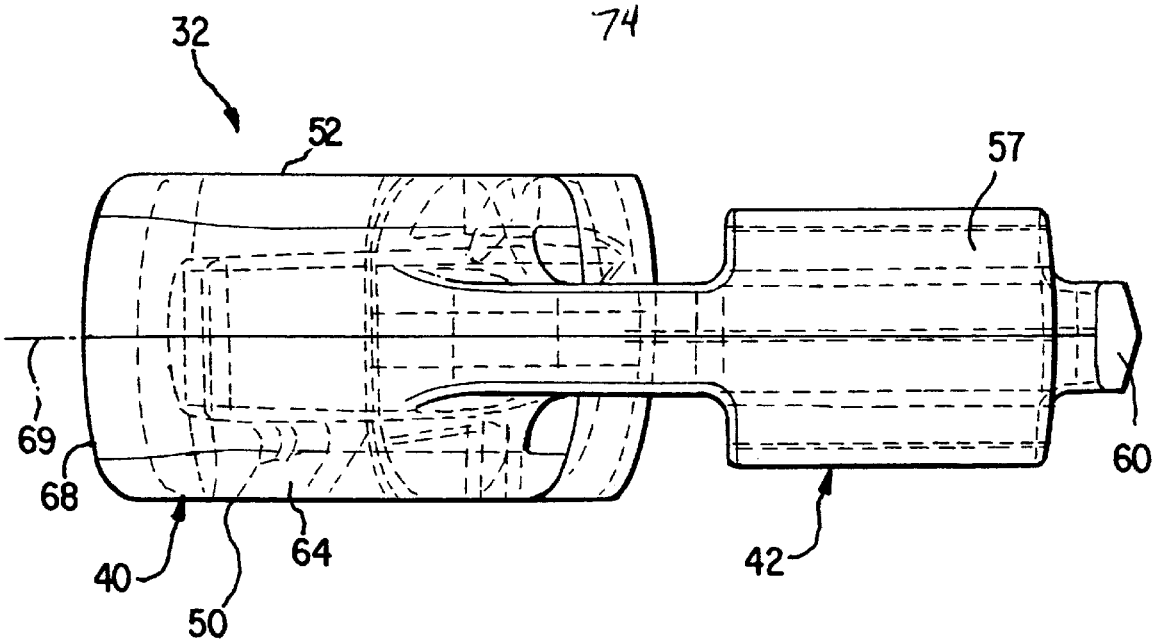
FIG. 3 is a top plan view of the base.
Figure 4:
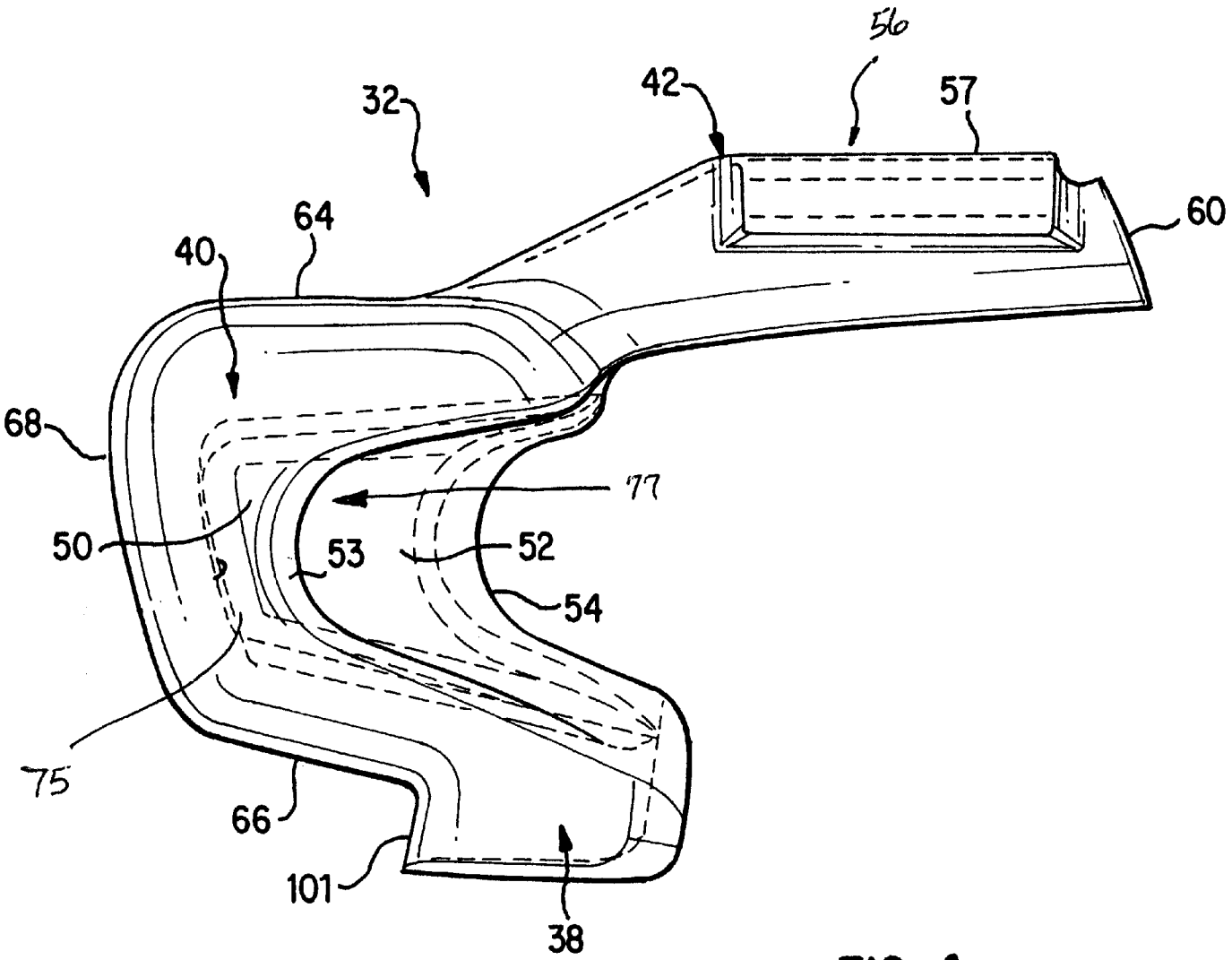
FIG. 4 is a side elevational view of the base.

Upper leg 42 extends rearward of body 40 along upper side 55 of the arm to define coupling configuration 56 for securing the adapter. The coupling configuration is preferably an axial T-shaped tongue 57 that slidably engages a complementary construction 58 on adapter 34. Nonetheless, other constructions provided with at least one laterally extending shoulder could be used to couple the adapter and the base. As examples, the coupling configuration 56 could be formed as a dovetail tongue or as a tongue with a T or dovetail shaped slot. In any event, the upper leg preferably extends initially upward above body 40 to enable the adapter to slide past the body and couple with the tongue. The rear end wall of upper leg 42 defines a rear bearing surface 60 adapted to engage lock 36. As discussed more fully below, the rear bearing surface is preferably curved and most preferably defines a convex spherical segment (FIG. 2). Nonetheless, a flat rear bearing surface could be used, albeit with reduced benefits.

The body 40 projects forward from the front edge 44 of arm 48 to resist the forces applied to the tooth 30 during use. In the preferred construction, the body includes sidewalls 50, 52, top and bottom walls 64, 66 and a front bearing surface 68. The front bearing surface 68 has a convex, curved shape, as discussed more fully below, to maintain a substantially full face contact with a complementary surface on the adapter during transverse loading of the tooth. In the preferred construction, front bearing surface 68 defines a convex spherical segment (as illustrated by the shaded portion in FIG. 2) to accommodate transverse loading in any direction, such as, side loads, upward loads, downward loads or virtually any load that applies a force transverse to the longitudinal axis 69 of the tooth. Nevertheless, bearing surface 68 could be formed with a surface that is curved in both horizontal and vertical directions but is not spherical. In this type of construction the radii of curvature for either or both curved directions could be fixed or variable. Moreover, the bearing surface 68 could be provided with a curved shape in only one direction, although with reduced benefits. For instance, bearing surface 68 could be curved in only a horizontal or vertical direction or in any particular desired direction. However, when curved in only one direction, the desired full face contact can only be maintained for transverse loading in the same general direction as the curvature of the bearing surface.

The radius (or radii) of curvature defining bearing surface 68 is based upon the relative gap that exists between the base and the adapter. For instance, a clearance is formed between the parts to ensure the adapter can be coupled to the base, especially along the coupling configuration. When a lateral load is applied to the tooth tip, the adapter will rotate until the gaps along the sides close at diagonally opposing corners forming a couple to oppose the lateral load. If the gap between the base and the adapter is the same along the front end and the rear end of base 32, then the center of rotation of the adapter will be at about the mid point M of base 32 (i.e., the mid point between bearing surfaces 60, 68). However, if the gap is smaller at one end as compared to the other end, then the center of rotation will be closer to the end with the smaller gap depending on the amount of the disparity between the parts, i.e., the greater the disparity in the gaps, the greater the center of rotation shifts toward the end with the smaller gap. In the preferred construction, the center of rotation is used as the imaginary center point for the radius of curvature. As can be appreciated, the differences in the clearance along the sides could be different than the clearance along the top and bottom of the base and adapter. In this construction, the curvature in the horizontal direction is preferably different than the curvature in the vertical direction so as to correspond to the spacing of the different clearances.

In the preferred construction, as shown in FIG. 2, the rear bearing surface 60 is curved in the same way as front bearing surface 68, although they could be different. Accordingly, the rear bearing surface can be varied in the same manner as discussed above for front bearing face 68 (e.g., with curves in one or more directions). Preferably, the rear and front bearing surfaces 60, 68 are defined by radii of curvature that initiate from the same point that matches the center of rotation of the adapter. However, due to unavoidable deflection of the parts under heavy loads, there can be some divergence of the points defining the radii of curvature for the front and rear bearing surfaces. Further, rear bearing surface 60 can have a widely different starting point for defining the radius of curvature, or it can even by flat, though such a construction will impose higher stresses on the lock and rear of the base. Hence, the front and rear bearing surfaces may have the same curvature, but also may simply have corresponding curvatures, i.e., where the radius of curvature originates at the same point even though they may each have different lengths. For example, if the center of rotation of the adapter, as discussed above, is closer to the rear end than the front end, then rear bearing surface 60 will preferably have a smaller radius of curvature than front bearing surface 68.

Figure 5:
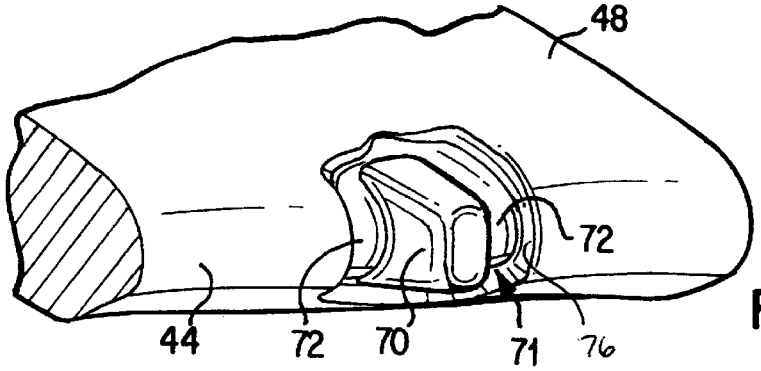
FIG. 5 is a perspective view of a portion of an arm of a dredge cutterhead in accordance with the present invention.
Figure 6:
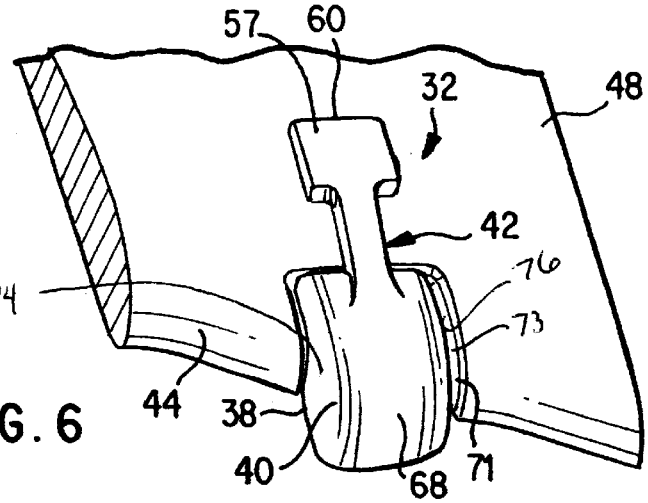
FIG. 6 is a top perspective view of the base positioned on the arm.

The front edge 44 of arm 48 is preferably provided with a plurality of spaced locator noses 70 (FIG. 5) for use with weld on bases 32. In the preferred construction, each locator nose is cast as part of the arm with a particular shaped core in the mold. The core is placed in the mold in the orientation needed for positioning each tooth properly on the arm. In this way, there are no difficulties in positioning the adapters on the arms. The locator noses cast in the arm already provide the desired orientation for the tooth. In the preferred construction, the locator nose projects from a recess 71 formed in the front edge of arm 48. The trough surfaces 72 in the bottom of the recesses oppose the inner edges 53, 54 of the sidewalls 50, 52 of the body of the base preferably leaving a small gap. This gap also enables the operator to more easily cut the base from the arm if needed. A space 73 preferably exists between the outer surfaces 74, 75 of sidewalls 50, 52 and the bevel surfaces 76 to accommodate the application of a weld. In use, the body 40 of base 32 defines a pocket 77 that receives the locator nose to properly position and support the base on the arm.

Figure 7:
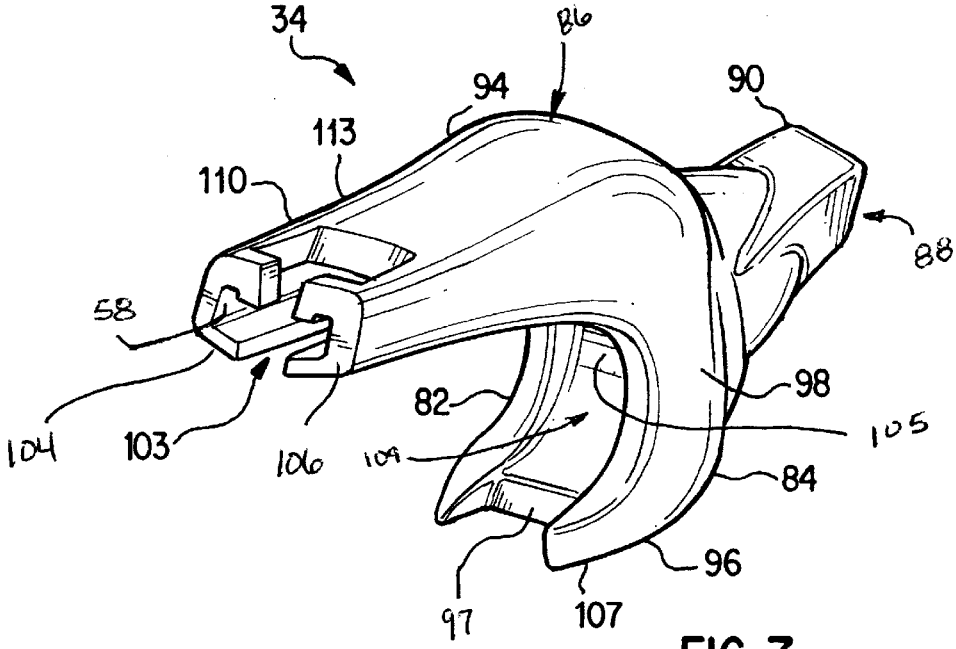
FIG. 7 is a rear perspective view of an adapter in accordance with the present invention.
Figure 8:
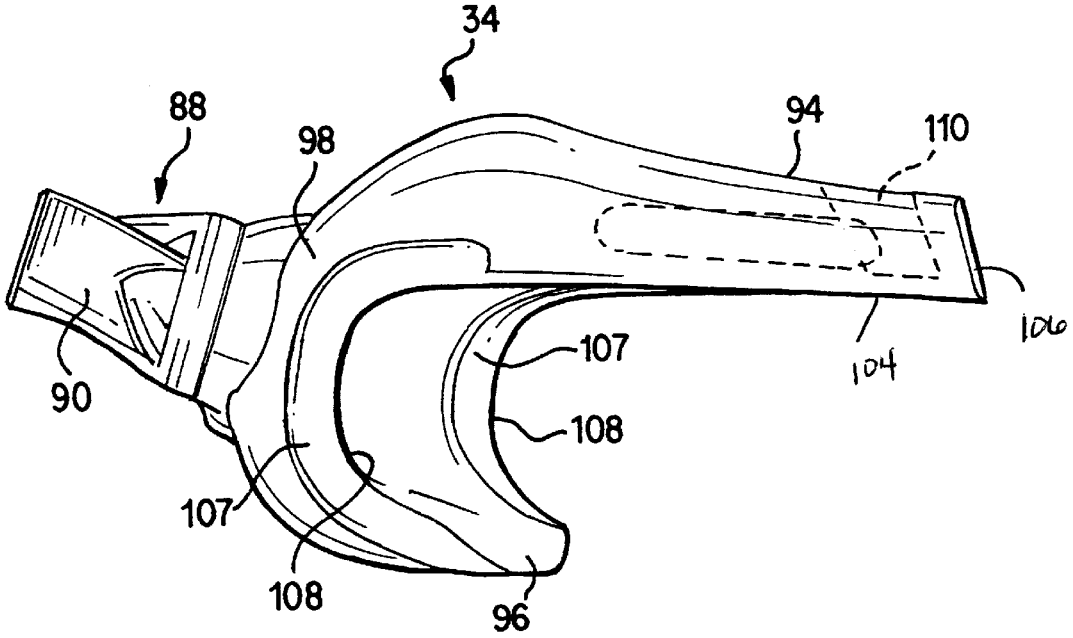
FIG. 8 is a side elevational view of the adapter.
Figure 9:
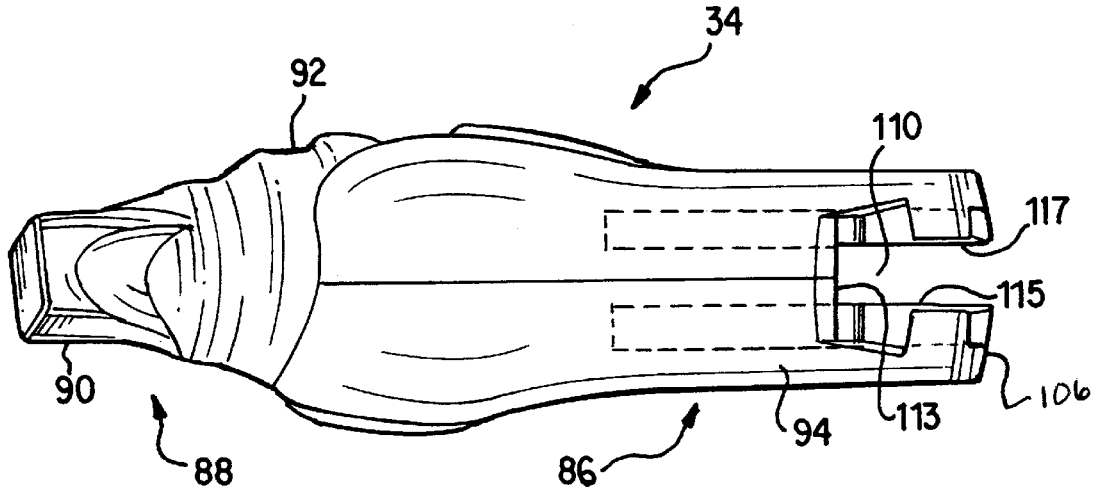
FIG. 9 is a top plan view of the adapter.
Figure 10:
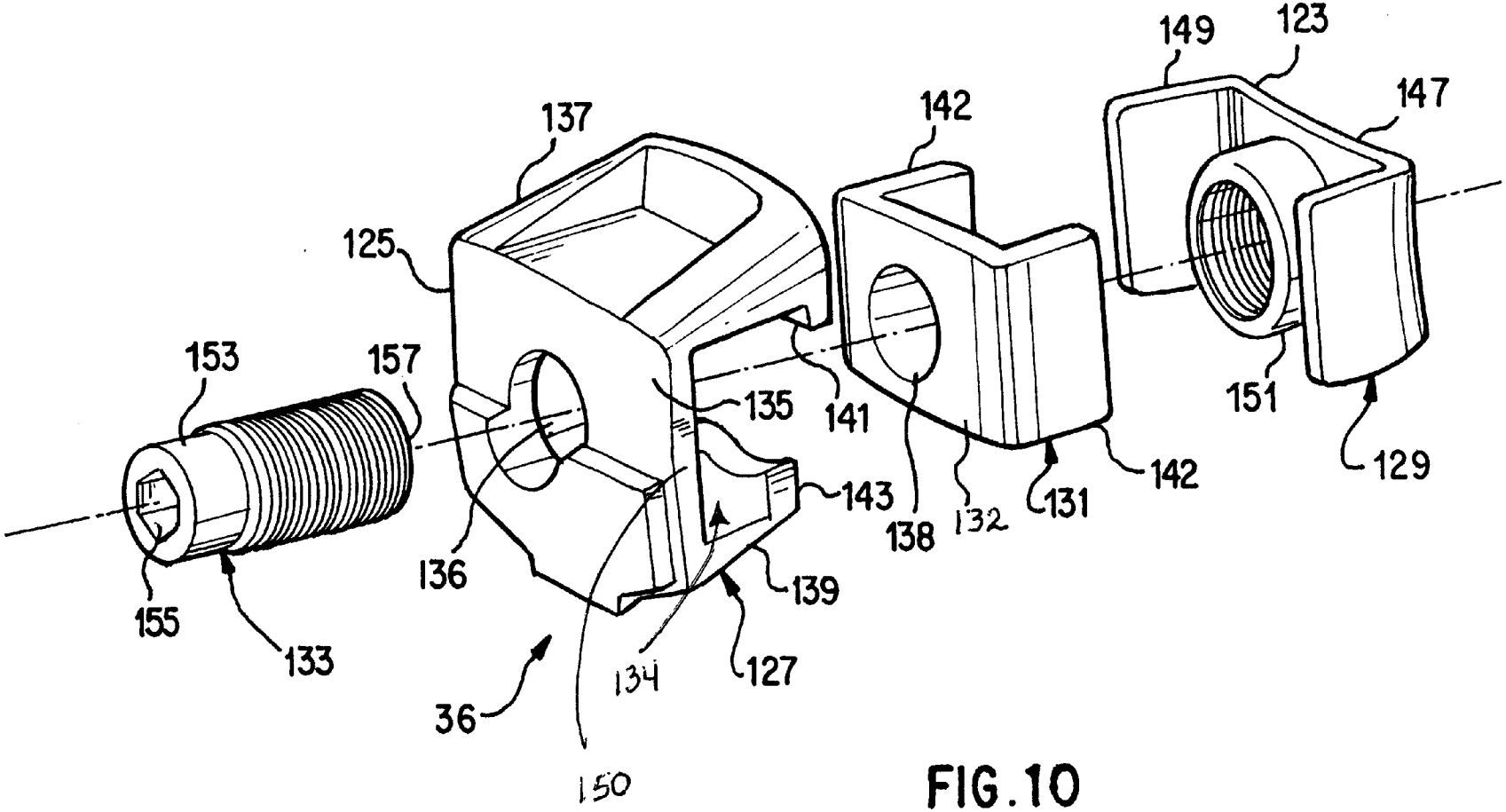
FIG. 10 is an exploded perspective view of a lock in accordance with the present invention.
Figure 11:
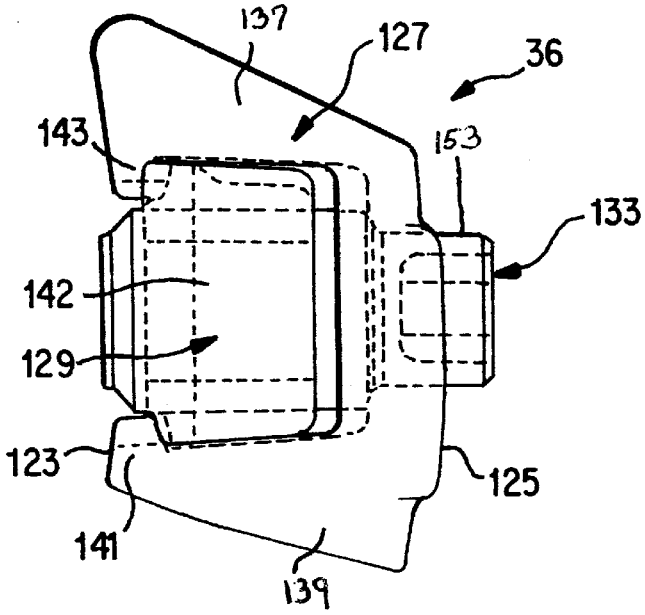
FIG. 11 is a side elevational view of the lock.
Figure 12:
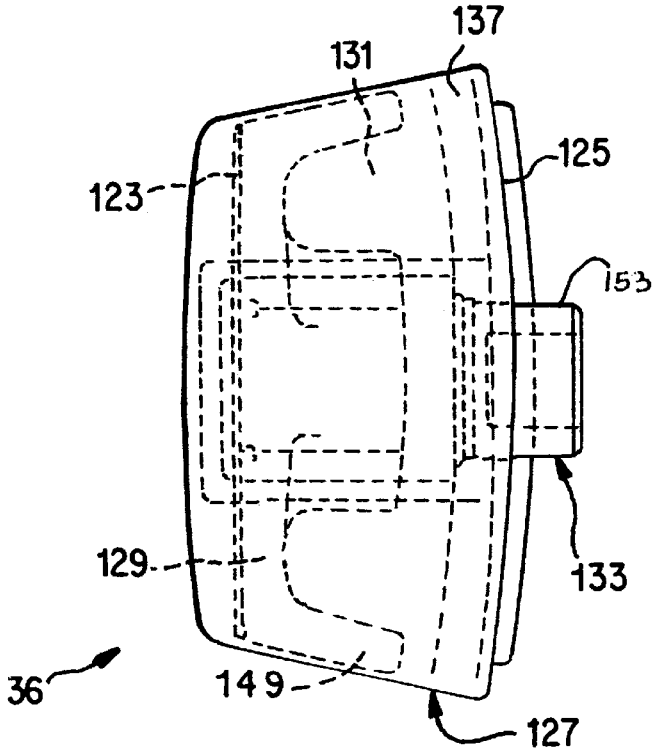
FIG. 12 is a top plan view of the lock.
Figure 13:
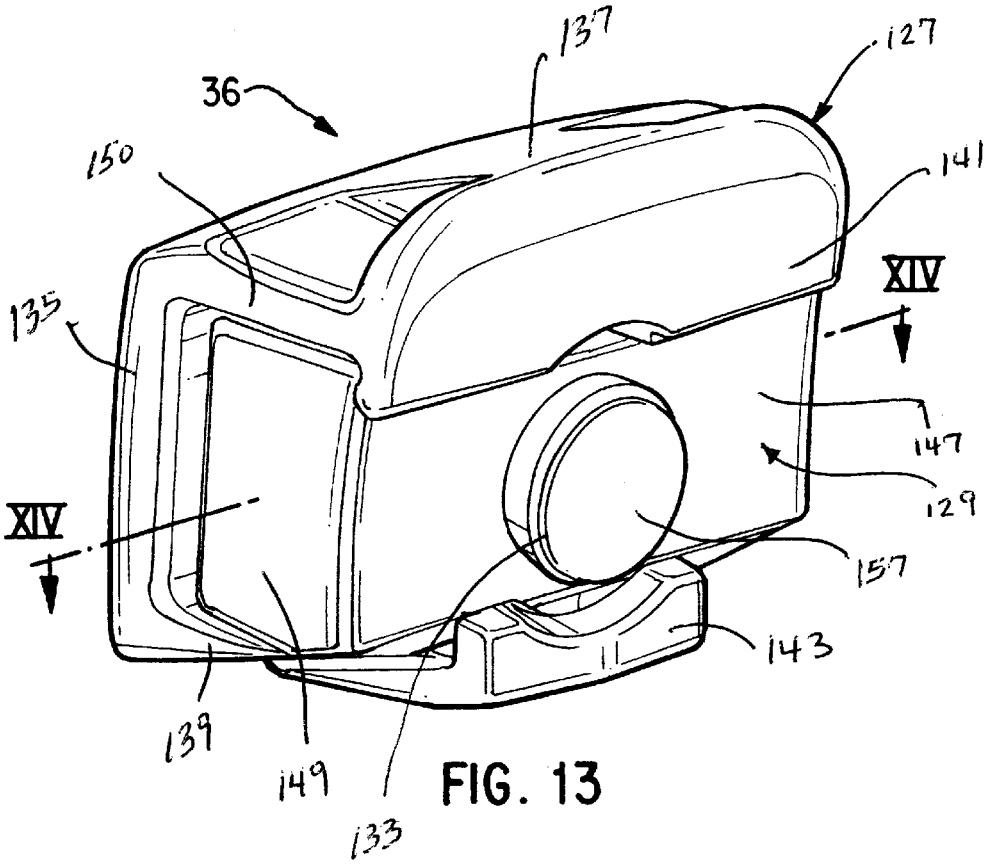
FIG. 13 is a perspective view of the lock.

Adapter 34 (FIGS. 1 and 7–9) has a rear portion 86 that mounts to base 32 and a front portion 88 for holding a point or tip (not shown). In the preferred construction, the front portion includes a forwardly projecting nose 90 that is received into the socket of a point. The nose can have any configuration for mounting a point. In this embodiment, the front portion further includes a slot 92 for receiving a lock pin (not shown) to hold the point to the adapter. The rear portion 86 includes an upper leg 94, a lower leg 96, and a mid portion 98. Lower leg 96 of adapter 34 overlies bottom wall 66. The rear end 97 of leg 96 opposes front wall 101 of the base so that under extreme loads wall 101 functions to stop the shifting of the adapter on the base. Upper leg 94 extends rearward to overlie top wall 64 and upper leg 42 of base 32. The upper leg of adapter 34 includes a coupling configuration 58 that is adapted to mate with the coupling configuration 56 of base 32. Hence, the coupling configuration of adapter 34 can be varied in the same way as the coupling configuration for base 32. In the preferred construction, upper leg 94 includes a T-shaped slot 103 that matingly receives T-shaped tongue 57. The T-shaped slot 103 is open along the inner surface 104 and in the rear wall 106 of upper leg 94 to facilitate receipt of tongue 57. Ribs 107 are preferably formed along the inner edge 108 of mid portion 98 for enhanced strength to resist cracking during use (FIGS. 1, 7 and 8).

The mid portion 98 of adapter 34 includes an interior recess 109 having an abutment or abutting surface 105 adapted to abut front bearing surface 68 of base 32. Abutment 105 is arcuate and concave in shape to match the arcuate front bearing surface 68. Accordingly, abutment 105 and bearing surface 68 each preferably define a spherical segment with essentially the same radius of curvature, although the curves could differ within a certain range of values primarily because of deflection that occurs in the parts under heavy loading. As discussed above, the preferred shape of abutment 105 and bearing surface 68 is defined by a radius of curvature that is determined by the clearance between the front and rear end portions of the adapter and base. In the most preferred configuration, the gaps between the base and the adapter are uniform from front to back along the sides and along the top and bottom so that the curved bearing surfaces 68, 105 each define a spherical segment. The actual desired size of the radius of curvature defining the spherical segments would depend on the gaps as well as the actual size of the part. As a general rule, the radius of curvature defining surfaces 68, 105 is preferably not larger than the length of base 32 (i.e., the distance between rear and front bearing surfaces 60, 68) to avoid having too broad of an arc.

Figure 15:
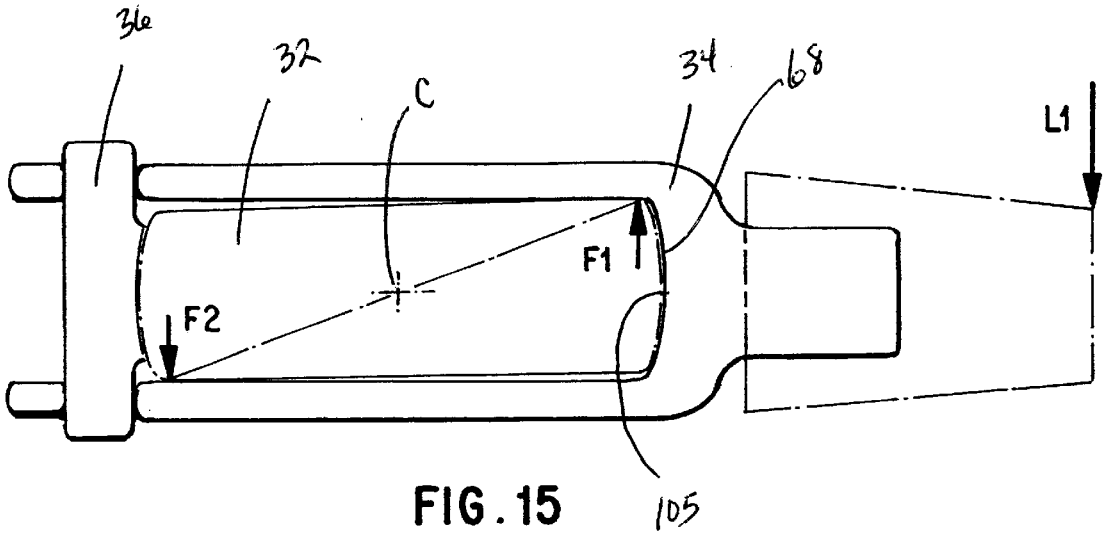
FIG. 15 is a top schematic view of a tooth in accordance with the present invention under side loading.
Figure 16:
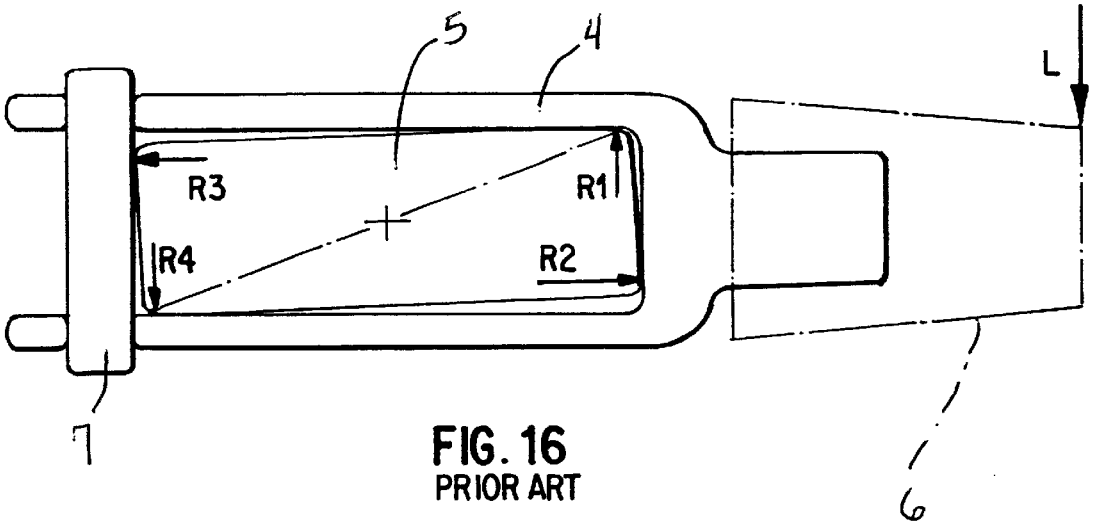
FIG. 16 PRIOR ART
FIG. 16 is a top schematic view of a prior art tooth under side loading.
Figure 17:
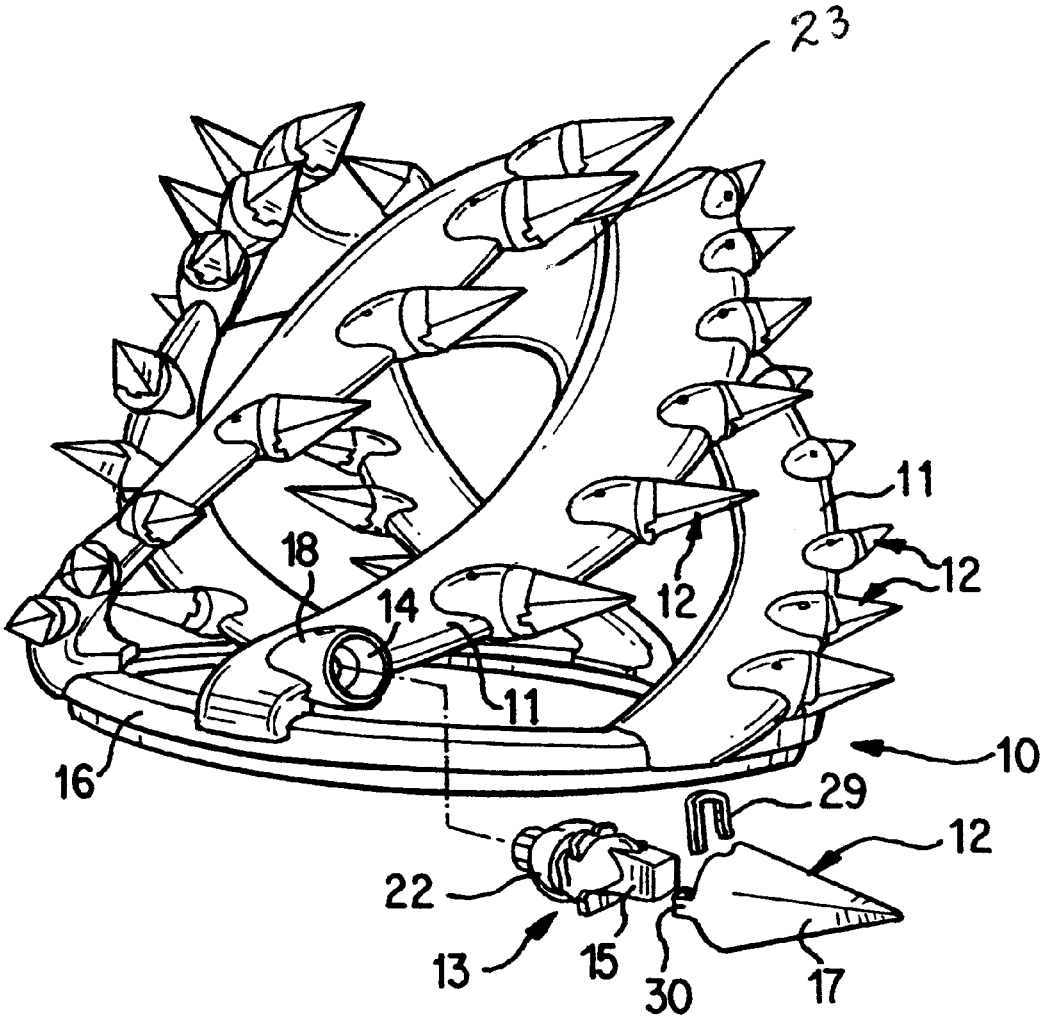
FIG.17 PRIOR ART
FIG. 17 is a perspective view of a prior art dredge cutterhead.
Figure 18:
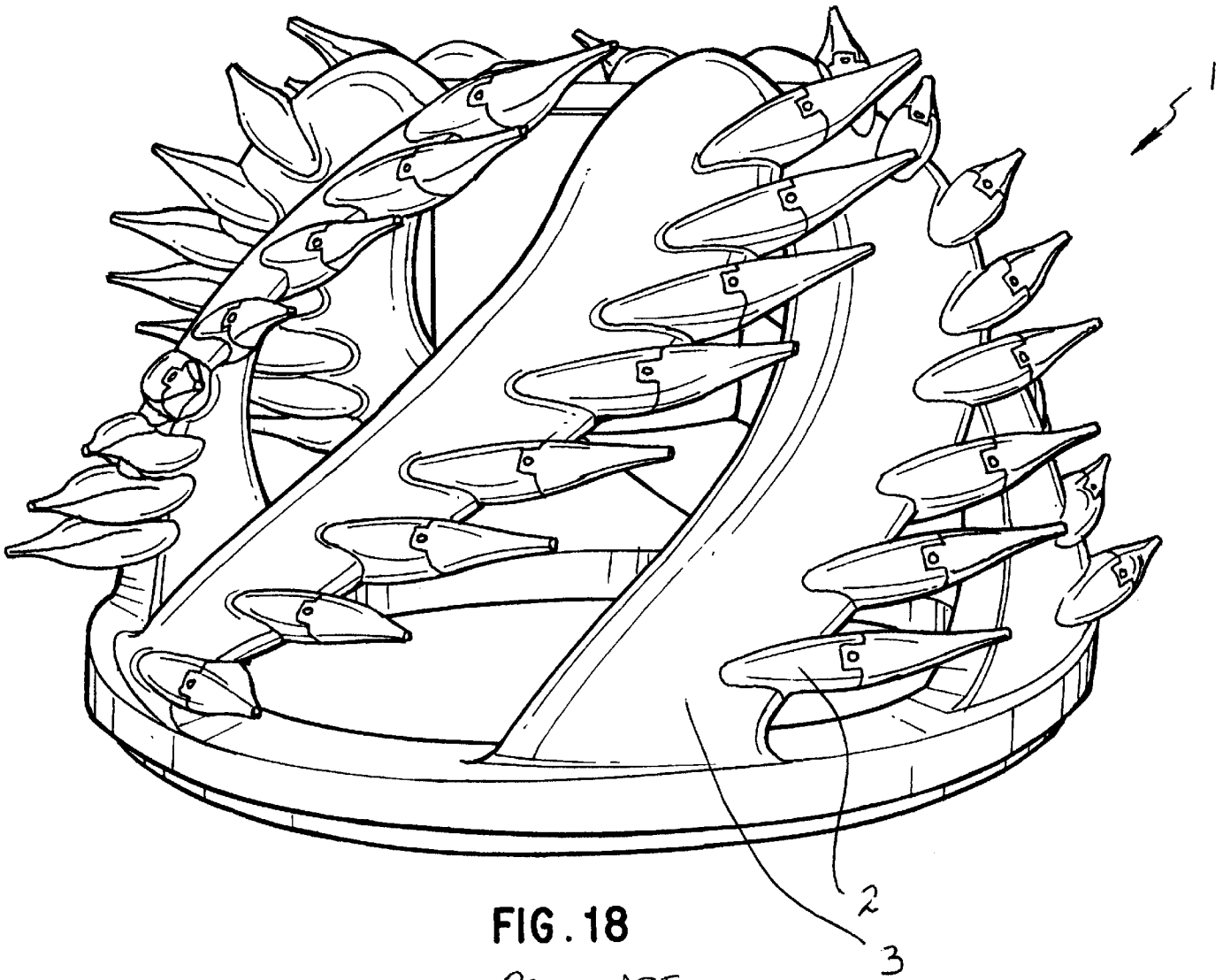
FIG. 18 PRIOR ART
FIG. 18 is a perspective view of another prior art dredge cutterhead.

As seen in FIG. 15, a side load L1 tends to rotate adapter 34 relative to base 32 about a center of rotation C. The radius of curvature defining bearing surfaces 68, 105 originate from the same center of rotation. Because of the mating arcuate configuration of abutment 105 and bearing surface 68, these surfaces remain in essentially full bearing contact with each other. Accordingly, no forces are applied as point contacts in the axial direction to prematurely wear the parts. Instead, the axial loads are spread out over substantially the whole of the abutment 105 and bearing surface 68 to greatly reduce the stress in the parts. As a result, the high stresses accompanying resultant forces R2, R3 (FIG. 16) are essentially eliminated.

Adapter 34 further includes an opening 110 in a rear portion of upper leg 94 (FIGS. 1 and 7–9). In the preferred construction, opening 110 has a generally rectangular configuration with a curved front wall 113 and a curved rear wall 115. Nevertheless, it is not necessary that the walls be curved or that the opening has an overall generally rectangular configuration. If there is any shifting of adapter 34 during use, the lock 36 tends to move with the adapter. Hence, there is ordinarily no significant shifting between the lock and the adapter and thus no undue wearing therebetween. Rear wall 115 preferably includes a hole 117 that extends through the rear end 106 of upper leg 94 to accommodate an adjustment assembly of lock 36. Nevertheless, hole 117 could have a variety of different shapes or be eliminated if an adjustment assembly is not used or one is used that does not require the space provided by hole 117.

Lock 36 is adapted to be received in opening 110 (FIGS. 1 and 10–14). In the preferred construction, lock 36 has a generally rectangular configuration with a curved front wall 123 and a curved rear wall 125 to match the configuration of opening 110. Although shifting between the adapter and lock is not likely, the curved walls 115, 125 tend to reduce any wearing in the event shifting occurs. Nevertheless, lock 36 may have a varied shape in the same way as discussed above for opening 110.

In the preferred construction, lock 36 comprises an outer part 127, an inner part 129, a resilient member 131 and an actuator, preferably in the form of a screw 133. Outer part 127 defines a cavity 134 for receiving the inner part 129 and resilient member 131. In general, outer part 127 is generally C-shaped to include a base wall 135, a top wall 137 and a bottom wall 139. A pair of lips 141, 143 extends toward each other from the top and bottom walls 137,139 to contain the inner part 129 and resilient member 131 in cavity 134. Base wall 135 includes an aperture 136 for receiving screw 133. The inner part also has a generally C-shaped configuration with a center wall 147 and two sidewalls 149. The two C-shaped components fit together to generally define a box-like shape. In the preferred curved construction, sidewalls 149 are at obtuse angles to center wall 147 to match the side edges 150 of outer part 127. An internally threaded boss 151 extends rearward from the center of center wall 147 to receive screw 133. Resilient member 131 is preferably an elastomer. In the preferred construction, the elastomer is composed of neoprene or rubber, although other types of elastomeric materials can be used. The elastomer is shaped for receipt in inner part 129 about boss 151. In the preferred embodiment, resilient member 131 has a base portion 132 with an aperture 138 and a pair of arm portions 142. Nevertheless, other shapes could be used. Moreover, other kinds of resilient members could be used, such as Bellville springs or a coiled spring.

The lock is assembled by placing the resilient member 131 about boss 151 in inner part 129. The combined inner part and resilient member are then inserted laterally into the side of cavity 134 in outer part 127, i.e., by side edges 150. Once boss 151 is aligned with aperture 136, screw 133 is preferably back threaded into boss 151 until it is received into aperture 136. The screw ensures that the component parts do not become inadvertently disassembled.

In use, lock 36 is inserted into opening 110 after adapter 34 is placed over base 32 with tongue 57 received in slot 103 (FIG. 1). Screw 133 includes a head 153 with some means for engaging a tool (not shown) for turning the screw. In the preferred embodiment, screw head 153 has internal flats 155 for receiving an appropriate wrench. The free end of screw 133 includes a bearing surface 157 that abuts rear bearing surface 60 when the screw is advanced.

Further advancement of screw 133 against rear bearing surface 60 causes the rear face 125 of base wall 135 to push rearwardly against the rear wall 115 of opening 110. This expansion of the lock results in abutment 105 of adapter 34 being brought into tight abutting relationship with front bearing surface 68 of base 32. Further advancement of screw 133 following such abutment will then cause the inner part 129 to move toward the outer part 127 to compress resilient member 131 until sidewalls 149 abut base wall 135. The sidewalls will abut base wall 135 to prevent overcompression of the resilient member. If the elastomer is a non-compressible rubber material or the like, there is enough open space between the inner and outer parts to permit the inner part 129 to be drawn against the outer part 127. Depending on the resistance in coupling the adapter to the base, the resilient member may compress in some instances before the adapter is fully tightened onto the base. In any event, with inner part 129 in abutting contact with outer part 127, lock 36 initially is a rigid lock member. As wear begins to develop between adapter 34 and base 32, resilient member 131 expands to dampen movement of the adapter relative to the base and maintain a tight relationship between the components of the tooth. This expansion of lock 36 continues to hold the components tightly together until resilient member 131 reaches its fully expanded position (i.e., when the inner part abuts against lips 141, 143).

Figure 14:
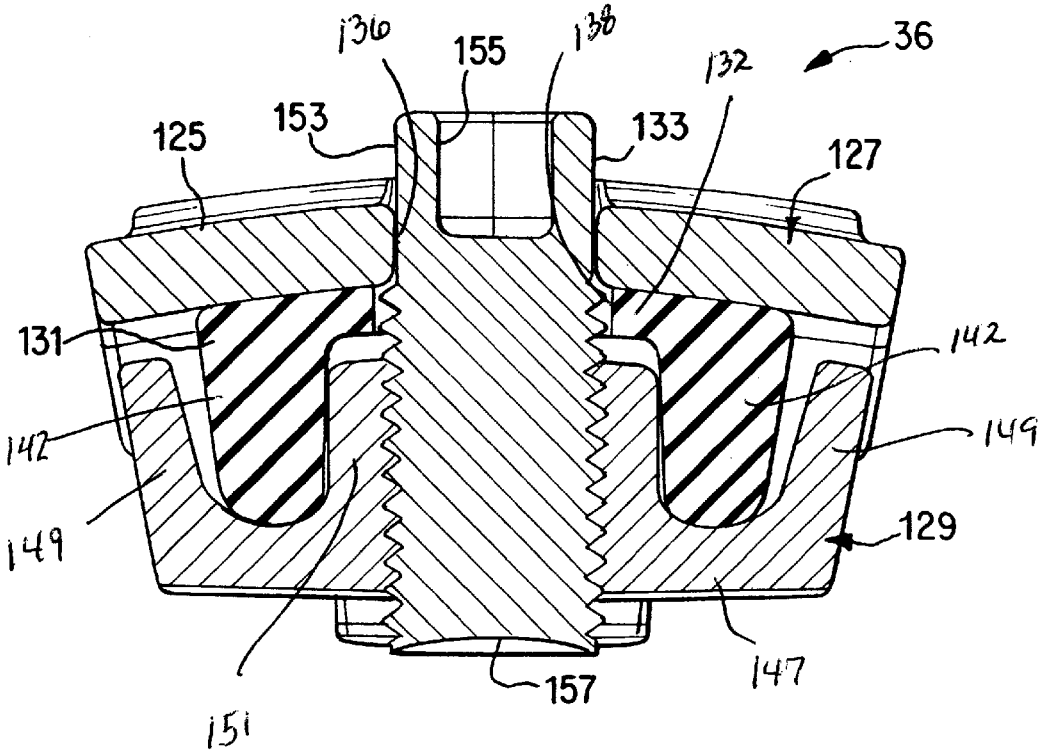
FIG. 14 is a cross-sectional view of the lock taken along line XIV—XIV in FIG. 13.

Bearing surface 157 on screw 133 preferably has a concave, arcuate surface to engage the corresponding rear bearing surface 60 (FIG. 14). In the most preferred construction, bearing surface 60 and 157 are each formed as a spherical segment. In this way, bearing surface 157 remains in substantially full contact with rear bearing surface 60 as adapter 34 shifts under transverse loading (i.e., as the adapter rotates about its center of rotation). While bearing surfaces 60 and 157 can be formed with the same radius of curvature, bearing surface 157 of screw 133 can alternatively be formed with a smaller radius of curvature so as to contact rear bearing surface 60 with a circular contact. The spherical configuration of the rear base surface still enables the circle contact of screw 133 to remain in substantially full contact with base 32 during any shifting of the adapter.

Alternatively, other locks could be used so long as they abut adapter 34 and base 32 so as to prevent the adapter from sliding forwardly off of the base. For example, a lock with a different adjustment assembly could be used, such as the fluid actuator as disclosed in U.S. Pat. No. 5,653,048 to Jones et al., herein incorporated by reference. Similarly, an opening and lock such as disclosed in U.S. Pat. No. 5,088,214 to Jones et al., herein incorporated by reference, without an adjustment assembly could also be used.

The above-discussion concerns the preferred embodiments of the present invention. Various other embodiments as well as many changes and alterations may be made without departing from the spirit and broader aspects of the invention as defined in the claims.

What is claimed is:

1. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion, wherein the front bearing surface and the abutting surface are each curved in two perpendicular directions; and a lock received into the opening to oppose the rear bearing surface and the bearing wall of the opening to prevent release of the coupling configurations in the release direction and thereby hold the wear member to the base.

2. An assembly in accordance with claim 1 in which the front bearing surface and the abutting surface are each mutually curved at substantially the same radius of curvature.

3. An assembly in accordance with claim 1 in which the lock includes a contact surface in engagement with the rear bearing surface, and the contact surface and the rear bearing surface are each curved.

4. An assembly in accordance with claim 3 in which the contact surface and the rear bearing surface have substantially the same radius of curvature.

5. An assembly in accordance with claim 1 in which one of the first and second coupling configurations is a tongue with at least one lateral shoulder and the other one of the first and second coupling configurations is a slot to matingly receiving the tongue.

6. An assembly in accordance with claim 5 in which the first coupling configuration is a T-shaped tongue and the second coupling configuration is a T-shaped slot.

7. An assembly in accordance with claim 1 in which the first coupling configuration is a tongue and the second coupling configuration is a slot.

8. An assembly in accordance with claim 1 in which the lock includes a first contact surface that opposes the bearing wall and a second contact surface that opposes the rear bearing surface, wherein the lock further includes an actuator that selectively moves the first and second contact surfaces away from each other to tighten the engagement of the wear member on the base.

9. An assembly in accordance with claim 8 in which the second contact surface and the rear bearing surface are each curved.

10. An assembly in accordance with claim 1 wherein the base is cast as a unitary portion with an arm of a dredge cutterhead.

11. An assembly for mounting a wear member to excavating equipment comprising:

a base adapted to be fixed to a digging portion of an excavator, the base including a first coupling configuration, a front bearing surface, and a rear bearing surface;

a wear member including a second coupling configuration that fits with the first coupling configuration to prevent release of the wear member except in a release direction, an abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base, the lock including an actuator and a resilient member, wherein when the lock is in the opening the actuator is operable to draw the wear member on the base into a tighter fit and to compresses the resilient member, and wherein the resilient member expands the lock to tighten the engagement of the wear member on the base as wear develops in the assembly.

12. An assembly in accordance with claim 11 in which the lock includes a first contact surface that opposes the bearing wall and a second contact surface that opposes the rear bearing surface, wherein the lock further includes an actuator that selectively moves the first and second contact surfaces away from each other to tighten the engagement of the wear member on the base.

13. An assembly in accordance with claim 12 in which the actuator includes a screw, the free end of which defines one of the first and second contact surfaces.

14. An assembly in accordance with claim 13 in which the free end of the screw defines the second contact surface.

15. An assembly in accordance with claim 12 in which the second contact surface and the rear bearing surface are each curved.

16. An assembly in accordance with claim 15 in which the second contact surface and the rear bearing surface each define a spherical segment.

17. An assembly in accordance with claim 11 in which the lock includes a front member, a rear member and a resilient member therebetween, wherein the actuator is adapted to compress the resilient member between the front and rear members when the lock is in the opening such that the resilient member can tighten the wear member on the base as wear occurs between the wear member and the base.

18. An assembly in accordance with claim 17 in which the actuator is a screw.

19. An assembly in accordance with claim 18 in which the resilient member is an elastomer.

20. An assembly in accordance with claim 17 in which the resilient member is an elastomer.

21. An assembly in accordance with claim 17 wherein the lock further includes at least one stop for limiting the compression of the resilient member.

22. An assembly in accordance with claim 11 wherein the base is cast as a unitary portion of the excavator.

23. An assembly in accordance with claim 11 wherein the wear member is an adapter provided with a nose for supporting a tooth point.

24. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion, wherein the front bearing surface and the abutting surface are each mutually curved at substantially the same radius of curvature and are each curved in two perpendicular directions; and a lock received into the opening to oppose the rear bearing surface and the bearing wall of the opening to prevent release of the coupling configurations in the release direction an thereby hold the wear member to the base.

25. An assembly in accordance with claim 24 in which the front bearing surface and the abutting surface each define a spherical segment.

26. An assembly in accordance with claim 25 in which the lock includes a contact surface, and the contact surface and the rear bearing surface have substantially the same radius of curvature.

27. An assembly in accordance with claim 26 in which the lock includes a contact surface in engagement with the rear bearing surface, and the contact surface and the rear bearing surface each define a spherical segment.

28. An assembly in accordance with claim 27 in which the radius of curvature for the front bearing surface and for the rear bearing surface originate from the substantially same point.

29. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface, wherein the front and rear bearing surfaces are each curved in two directions;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base.

30. An assembly in accordance with claim 29 in which the front and rear bearing surfaces are each defined by a radius of curvature in each of the two perpendicular directions.

31. An assembly in accordance with claim 30 in which the radii of curvature for the front and rear bearing surfaces defining the curves in a one of the directions originate from the same point.

32. An assembly in accordance with claim 31 in which the radii of curvature for the front and rear bearing surfaces defining the curves in the other of the directions originate from the same point.

33. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base, wherein the lock includes a first contact surface that opposes the bearing wall, a second contact surface that opposes the rear bearing surface, an actuator that selectively moves the first and second contact surfaces away from each other to tighten the engagement of the wear member on the base, a front member, a rear member and a resilient member therebetween, wherein the actuator is adapted to compress the resilient member between the front and rear members when the lock is in the opening such that the resilient member can tighten the wear member on the base as wear occurs between the wear member and the base.

34. An assembly in accordance with claim 33 in which the actuator is a screw.

35. An assembly in accordance with claim 34 in which the resilient member is an elastomer.

36. An assembly in accordance with claim 33 in which the resilient member is an elastomer.

37. An assembly in accordance with claim 33 wherein the lock further includes at least one stop for limiting the compression of the resilient member.

38. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base, wherein the lock includes a contact surface in engagement with the rear bearing surface, and the contact surface and the rear bearing surface are each curved in two perpendicular directions.

39. An assembly in accordance with claim 33 in which the contact surface and the rear bearing surface each define a spherical segment.

40. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface, wherein the rear bearing surface is curved, the front and rear bearing surfaces are each defined by a radius of curvature, and the radii of curvature for the front and rear bearing surfaces have the same origination point;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base.

41. An assembly in accordance with claim 40 in which the front and rear bearing surfaces each define a spherical segment.

42. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base, wherein the lock includes a first contact surface that opposes the bearing wall and a second contact surface that opposes the rear bearing surface, wherein the lock further includes an actuator that selectively moves the first and second contact surfaces away from each other to tighten the engagement of the wear member on the base, and wherein the actuator includes a screw, the free end of which defines one of the first and second contact surfaces.

43. An assembly in accordance with claim 42 in which the free end of the screw defines the second contact surface.

44. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base, wherein the lock includes an actuator and a resilient member, and wherein the actuator compresses the resilient member and the resilient member expands the lock to tighten the engagement of the wear member on the base.

45. An assembly for mounting a wear member to excavating equipment comprising:

a base adapted to be fixed to a digging portion of an excavator, the base including a first coupling configuration, a convex front bearing surface curved across substantially the entire front bearing surface, and a rear bearing surface;

a wear member including a second coupling configuration that fits with the first coupling configuration to prevent release of the wear member except in a release direction, a concave abutting surface curved across substantially the entire abutting surface to abut the front bearing surface, an opening having a bearing wall, and a forwardly projecting working portion; and a lock received into the opening to oppose the rear bearing surface and the bearing wall of the opening to prevent release of the coupling configurations in the release direction and thereby hold the wear member to the base, wherein the lock includes a first contact surface that opposes the bearing walls and a second contact surface that opposes the rear bearing surface, wherein the lock further includes an actuator that selectively moves the first and second contact surfaces away from each other to tighten the engagement of the wear member on the base, and wherein the second contact surface and the rear bearing surface are each curved, and the second contact surface and the rear bearing surface each define a spherical segment.

* * * * *

UNITED STATES PATENT AND TRADEMARK OFFICE

CERTIFICATE OF CORRECTION

PATENT NO. : 6,729,052 B2
APPLICATION NO. : 09/986705
DATED : May 4, 2004
INVENTOR(S) : Charles D. Ollinger, IV et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by (213) days Delete the phrase "by 213 days" and insert --by 130 days--

In Claim 24 at Column 12, Line 24:
Please replace "an" with --and--.

Signed and Sealed this

Twelfth Day of September, 2006

JON W. DUDAS
*Director of the United States Patent and Trademark Office*